United States Patent [19]

Kirkman-Amemiya

[11] Patent Number: 5,057,740

[45] Date of Patent: Oct. 15, 1991

[54] PHOTOEMISSIVE TRIGGER FOR BACKLIGHTED THYRATRON SWITCHES

[75] Inventor: George F. Kirkman-Amemiya, Los Angeles, Calif.

[73] Assignee: Integrated Applied Physics, Inc., Pasadena, Calif.

[21] Appl. No.: 531,127

[22] Filed: May 31, 1990

[51] Int. Cl.[5] ..... H01J 40/00; H01J 40/06

[52] U.S. Cl. ..... 313/542; 313/572; 313/296; 313/538

[58] Field of Search ..... 313/572, 573, 577, 296, 313/297, 542, 538

[56] References Cited

U.S. PATENT DOCUMENTS 4,335,465 6/1982 Christiansen et al. ..... 372/156
4,771,168 9/1988 Gunderson et al. ..... 313/538

OTHER PUBLICATIONS

Boggasch et al., "A 400 KA Pulse Generator with Pseudo-Spark Switches", European Organization for Nuclear Research (CERN/PS/85-30(AA)), Geneva, Switzerland, 7/1985.

Mechtershimer et al., "Multichannel Pseudospark Switch", J. Physics E: Sci. Instrum. 20, 270 (1987).

Frank et al., "High-Power Pseudospark and BLT Switches", IEEE Trans. Plasma Science, 1988.

Christiansen et al., "Production of High Current Particle Beams by Low Pressure Spark Discharge", Zeitschrift für Physik A290, 35(1979).

Bloess et al., Nuclear Instr. & Methods 205, 173 (1983).

*Primary Examiner*—Donald J. Yusko
*Assistant Examiner*—Nimeshkumar Patel
*Attorney, Agent, or Firm*—Kenway & Crowley

[57] ABSTRACT

Provided is a means for triggering certain high voltage electronic, gas discharge switches that are a novel type of high power thyratron. Triggering of switches of the so-called "backlighted thyratron" type (a type of cold cathode thyratron) is enhanced by the inclusion of a very small, photoemissive cathode, separate and isolated from the main switch electrodes, to initiate the triggering discharge. The trigger cathode is protected from destruction by the main discharge current through the switch by mechanically and electrically isolating it from further participation in the discharge once the triggering process has been initiated. Alternatively, photosensitive material is coated on the backside of one of the main switch electrodes. A light source located externally of the switch directs light through a sealed aperture into the interior of the switch where it is incident on the photosensitive material generating electrons which in turn trigger the main switch discharge.

14 Claims, 2 Drawing Sheets

PHOTOEMISSIVE TRIGGER FOR BACKLIGHTED THYRATRON SWITCHES

BACKGROUND OF THE INVENTION

The present invention relates to high voltage electronic gas discharge switches and in particular to thyratron switches of the backlighted type.

Thyratron switches are used to switch energy stored in capacitors or pulse forming networks in order to drive high voltage pulse power devices such as pulse generators, lasers, radar transmitters, and particle accelerators. The so-called pseudospark and backlighted thyratron (BLT) switches, two novel types of switches recently developed in both Europe and America, has, for many typical switching applications, required elaborate triggering means to achieve the desired switching characteristics. Some of these means involve unacceptable complications in switch support circuitry for what is intended to be an easily-applied, commercial device; others employ triggering devices which are incompatible with inclusion in a hermetically-sealed device.

Triggering refers to the process of closing of a type of electronic switch by initiating the electrical discharge in the switch so that the switch conducts current. In the present instance, triggering refers to closing a thyratron switch comprised of two (or sometimes more) electrodes in an evacuated envelope filled with a low pressure gas for supplying electrons and ions. Specifically, this invention relates to a switch called a "backlighted thyratron" (BLT) switch, which is an optically-triggered version of the thyratron switch. In the present invention, an opto-electronic trigger is used that simplifies and improves the triggering method for the backlighted device.

Switches of pseudospark or backlighted type can be triggered in several different ways, and once triggered, these switches conduct with short delay and little jitter. The problem, however, is (in common with other "cold-cathode" devices) that long and erratic breakdown delay times and excessive "high impulse ratio" trigger breakdown voltages may be encountered when establishing the trigger discharge itself in the first place.

In the absence of a heated thermionic cathode or other copious source of electrons, there may be relatively few electrons emitted or favorably placed prior to trigger breakdown to cause a triggering discharge of the desired characteristics to take place. Therefore, to meet the often simultaneous and conflicting requirements for short delay, low jitter, long life, and reasonable triggering requirements, some enhancement of the cold cathode switch triggering arrangements is generally necessary, particularly where the new backlighted approach is intended to retrofit or replace a structure originally utilizing a hot cathode.

Many triggering methods and circuit variations have been devised to improve pseudospark/BLT triggering performance. A review is presented in "High Power Hollow Electrode Thyratron-Type Switches," K. Frank, E. Boggasch, J. Christiansen, A. Goertler, W. Hartmann, C. Kozlik, G. Kirkman, G. Braun, V. Dominic, M. A. Gundersen, H. Riege and G. Mechtersheimer, IEEE Tans. Plasma Science, published in 1988. The methods described for triggering include a pulsed-glow discharge or charge injection trigger, and a slide-spark (surface-discharge) trigger. These triggering methods, which are those used in the pseudospark switch, are also described in the article "High Power Hollow Electrode Thyratron-Type Switches," by the same authors in the Proceedings, Sixth IEEE Pulse Power Conference, June, 1987. These articles present reviews of the state of the art.

Additional descriptions of trigger methods are contained in the articles J. Christiansen and Ch. Schultheiss, "Production of High Current Particle Beams by Low Pressure Spark Discharges," Zeitschrift für Physik A290, 35 (1979); D. Bloess, I. Kamber, H. Riege, G. Bittner, V. Brückner, J. Christiansen, K. Frank, W. Hatmann, N. Lieser, Ch. Schultheiss, R. Seeböck, and W. Steudtner, Nuclear Instr. & Methods 205, 173 (1983); E. Boggasch, H. Riege, and V. Brückner, "A 400 kA Pulse Generator with Pseudospark Switches," European Organization for Nuclear Research (CERN/PS/85-30(AA)), Geneva, Switzerland, July, 1985; K. Frank, E. Boggasch, J. Christiansen, A. Goertler, W. Hartmann and C. Kozlik, "HIgh Repetition Rate Pseudospark Switches for Laser Application," Proceedings of SPIE 735, Pulse Power for Lasers, 74, 1987. See also G. Mechtersheimer and R. Kohler, "Multichannel Pseudospark Switch (MUPS)" J. Physics E: Sci. Instrum. 20, 270 (1987). A patent that is related to this art is U.S. Pat. No. 4,335,465, 6/982, J. Christiansen and C. Schultheiss.

As will be appreciated by those who are familiar with triggered gas discharge devices, however, the triggering methods so far described are either complex and cumbersome, or if simple, fail to produce triggering compatible with such factors as repetition rate, energy per pulse, peak current, current rate of rise, pulse to pulse jitter, delay in triggering, life, ability to conduct reverse current, and other operating conditions and requirements affected by or dependent upon triggering. Such factors, either singly or in combination, often constitute the essential limitations in the performance characteristics of the switch in a given application.

For example, attempting to trigger the device with the simple exposed wire electrode used in the first experimental pseudospark devices generally results in unacceptable time delays and jitter due to the long and erratic formative times for the long-path discharge. If triggering is wanted within a microsecond or less, as much as 7 kilovolts may be required to break down a long-path gap that under steady DC conditions will eventually self fire with only 300 or 400 volts applied. Where a pulse-to-pulse time jitter of less than a few nanoseconds is desired, the initial trigger breakdown will often show jitter several hundred times as large. Increasing the tube pressure to obtain better triggering typically degrades short-path high voltage hold off between the main electrodes. Other approaches such as trying to enhance triggering by use of sharp points, low work function metals, high secondary-emission surfaces, dielectric discontinuities, "sparkers" and other techniques used in high pressure spark-gap triggering (i.e. in devices operating on the "right-hand side of the Paschen curve") are also of little or no use.

In a similar vein, the use of a mylar spark-slide or flash-board to promote low-pressure breakdown by a surface discharge, while acceptable in an unsealed laboratory prototype attached to a pump and gas handling apparatus, is completely unacceptable in a sealed-off device, where gas purity must be maintained for thousands of hours during life.

Even the use of optical techniques, for example instantaneous optical triggering by means of ultraviolet-emitting flash-tubes, begs the triggering question somewhat, for delay and jitter associated with the flash lamp itself are then encountered, and resort must be had to delay-reducing stratagems farther back in the trigger circuit, which add further complexity to the trigger chain. One result is undue cost and complexity; another is the impracticality of "stacking" the high voltage switch devices or configuring them in other desired modes; a third is lowering of the overall "power gain" of the switch.

It is, therefore, an object of this invention to obtain triggering of a backlighted thyratron comparable to the relatively simple, generally-satisfactory triggering of hot-cathode thyratron devices without foregoing the numerous advantages of the cold cathode pseudospark or backlighted switch. These are: essentially zero standby power, short warm up, long life, exceptionally high peak current capability without arcing, a relatively improved ability to isolate stages for the purpose of stacking, and high overall power gain.

SUMMARY OF THE INVENTION

The present invention simplifies triggering through use of an inexpensive, uncomplicated structure suitable for inclusion in a sealed-off gas discharge switch. It produces its triggering effect in a low pressure discharge that is characteristic of the pseudospark and the backlighted thyratron, as well as for thyratrons in general. This switch achieves high voltage holdoff by operation on the so called "left hand side of the Paschen minimum," i.e. in the region of rapidly rising breakdown voltage for a decreasing product of gas pressure times electrode separation, encountered in most devices close to the attainment of complete vacuum. A feature of such operation is that "short-path breakdowns" occur at much higher voltages than "long-path breakdowns," with the result that the high voltage electrodes of the switch itself are placed closer to each other rather than farther away, to achieve higher hold-off voltage. This is possible at pressures of the order of less than or about equal to 0.1 to 0.5 torr, or about 0.001 atm., and typical hold-off voltage under these conditions for operation with hydrogen or helium gas is about 35 kilovolts, with an electrode separation of about 2 to 3 mm.

Such operation is a standard method and has been used in modern high power hydrogen thyratrons that have been commercially available for about 40 years. A description of the operation of gas filled thyratrons is contained in the McGraw-Hill Encyclopedia of Science and Engineering. Thyratrons can operate with various elemental gases including hydrogen, helium, nitrogen, argon, neon, xenon, and krypton. The pressure of the gases is normally 0.1 to 0.5 torr. The function of the gas is to produce electrons and ions which form what is called a plasma, a state of matter through which very large electrical currents can be conducted. The current that is conducted in a thyratron such as the pseudospark or backlighted thyratron is higher than that conducted in a normal commercial thyratron, and may range from less than 1000 amperes to as much as 200,000 amperes.

The gas-filled high power electronic thyratron switch of the present invention may be used to transfer energy to a load such as a laser or particle accelerator. A high power energy source is connected to the switch, either to the anode or the cathode, and the other electrode of the switch is connected to the load. The energy source is usually a capacitor or a pulse forming network. The trigger of the present invention closes the switch, which then transfers energy from the source to the load. This aspect of operation is analogous to the function and operation of commercially available thyratrons.

These switches are to be distinguished from spark gap switches, in that current in a pseudospark or backlighted thyratron is normally conducted in a glow discharge mode, and normally not an arc or constricted arc mode. This difference is important for many applications, in that the spark gap conduction in an arc mode results in rapid degradation of electrodes, repetition rate limitations caused by arc-produced electrode material appearing between the gaps, and excessive gas supply requirements.

The pseudospark and backlighted thyratron switches are likewise to be distinguished from conventional thyratrons, in that they are capable of higher current, faster current rise, and other advantages described in the publications referenced above.

To trigger hydrogen or other types of conventional gaseous thyratrons, advantage is taken of the presence of a copious thermionic electron emitter, typically a very large, indirectly-heated cathode capable of emitting the entire current to be switched (hundreds to several thousands of amperes), in a chamber with dimensions somewhat larger than the 2 or 3 millimeters giving best high voltage holdoff between the main electrodes of the switch. By applying a brief positive pulse to a nearby grid or trigger electrode, "long-path" breakdown of the grid cathode space is caused to occur, and a discharge current of a few amperes is caused to flow in a part of the chamber accessible to fields associated with the high voltage electrodes. The resulting electrical disturbance then causes "short-path" breakdown to occur a few tenths of a microsecond later in the high voltage holdoff space (aperture) between the high voltage electrodes of the switch, thus completing the circuit between cathode and anode and rendering the switch conductive.

Such hot-cathode thyratrons are typically triggered by an easily supplied grid drive of a few hundred volts to several thousand volts through an impedance of several 10's of ohms. These switches typically show short and fairly stable anode delay times (delays of at most a few tenths of a microsecond between triggering and full conduction), limited drifts in anode delay time, and essentially no pulse-to-pulse jitter ($tJ < 1$ ns).

There are numerous disadvantages to this mode of operation, however. The chief disadvantages of the typical thermionic cathode include: extremely slow warm-up, the inability to emit enough electrons to support extremely high switch currents or long pulses without destructive arcing, the consumption of inordinately large amounts of heater power during standby operation, relatively short life compared to other switch components, and the degradation of high voltage holdoff during standby due to the slow evaporation of low work-function material from the hot cathode. In addition, due to the difficulty of isolating the large, high-current filament supplies and other apparatus required, the ability to stack switch devices in series to reach higher voltages is severely limited.

A major objective of the backlighted thyratron of the present invention is to eliminate the massive hot thermionic cathode and its associated difficulties, and make best use of the superior properties of the backlighted thyratron cathode, which, among other things, remains essentially cold during standby operation. Elimination of the hot cathode, however, means that the relatively easy triggering method described above is no longer applicable, and an alternate triggering method must be used.

The pseudospark and backlighted thyratron electrode structure requires relatively a small number (about one billion) of electrons placed in the cathode aperture to initiate the discharge. In one embodiment, the starting electrons are produced by photoemission using ultraviolet light incident on the back side of the cathode surface. Typically a small amount of unfocused UV light is incident near the cathode aperture and the required electrons are produced by photoemission from the metal cathode surface which is typically a refractory metal such as molybdenum or tungsten. The photoelectric work function for these metals is about 4 eV; therefore, light with wavelengths shorter than about 300 nm is used to produce the required electrons. Even at these short wavelengths, the quantum efficiency of the cathode surface is low and about ten million photons are required to produce a single electron. Light sources required for this triggering method are excimer lasers and pulsed flashlamps. In the presently preferred embodiment, the present system simplifies triggering by using an auxiliary cathode with a lower photoelectric work function and a high quantum efficiency to produce the required starting electrons using a longer wavelength light that is produced by a simple source such as a light emitting diode.

In the preferred embodiment, the auxiliary cathode is located in the hollow cathode backspace such that it is protected from the main discharge plasma. A sweep electrode is used to draw the photoelectrons from the auxiliary cathode to the switch cathode aperture. This sweep electrode also serves as a blocking potential electrode that prevents premature breakdown. The auxiliary cathode is not required to participate in carrying the main discharge current and is, therefore, much smaller and can be less rugged than the hot cathode used in a normal thyratron.

As previously noted, in hot-cathode thyratrons, the job of supplying favorably placed triggering electrons was a useful auxiliary function of the large main cathode, which then proceeded to supply current for the main discharge. In the present invention, this job is taken over by a much smaller photoemissive cathode of extremely low power consumption and nearly instantaneous warm-up, whose sole function is to initiate the discharge. This auxiliary cathode, electrically isolated from the main switch cathode and anode, is arranged so that the appropriate main electrode can briefly serve as a triggering anode in order to draw a triggering discharge. The triggering discharge is then transferred to the cold main electrodes and finally initiates conduction through the switch.

The auxiliary cathode is mechanically and electrically defended against taking further part in the trigger discharge, or in the main discharge that follows, and it is also defended against damage from ion beams by its location in the hollow electrode space, by shielding and baffling, and by optional impedance protection. Baffling and shielding are also used to contain the electrostatic fields from the heater power leads. These fields can sometimes produce power-frequency modulation of the delay time when the heater is operated on AC.

Since the cathode is physically small (a few $mm^2$) and heavily baffled, degradation of the rest of the tube by cathode material evaporated from (the typically hundreds of $cm^2$ of) a normal thyratron cathode becomes much less of a problem.

DETAILED DESCRIPTION

Figure 1:
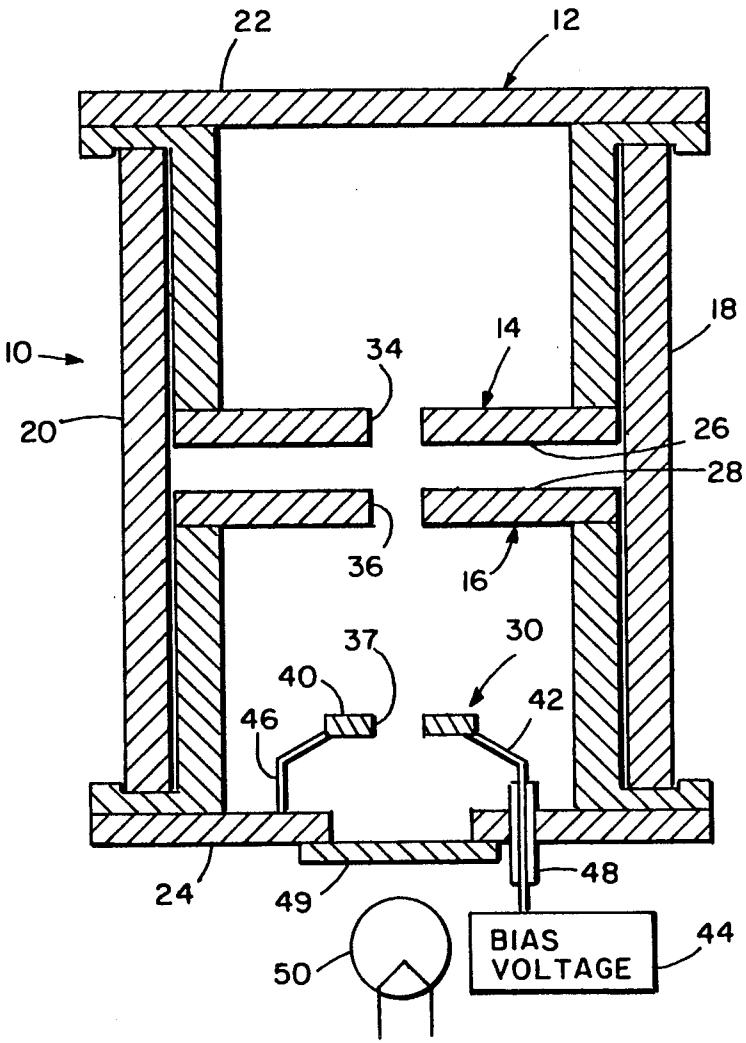
FIG. 1 is cross-sectional schematic diagram of a backlighted thyratron switch according to the present invention.

A backlighted thyratron switch 10 according to the present invention is shown in FIG. 1. As depicted therein, the thyratron switch comprises an envelope 12 and a first and second primary electrode, 14, 16. The envelope comprises primary insulators 18, 20 and the space within the envelope is enclosed by sealing members 22, 24. Electrodes 14, 16 are secured to insulators 18, 20 and, in turn, members 22, 24 are secured to the electrodes. In a presently preferred embodiment, electrode 14 is utilized as the anode and electrode 16 is utilized as the cathode. The active area of the anode is identified at 26 and the active area of the cathode at 28.

A photocathode 30 schematically illustrated in FIG. 1 is located a predetermined distance from cathode 16. Optionally this photocathode 30 could also be located in the vicinity of the anode. The structure and precise positioning of a presently preferred and an alternate embodiment of photocathode 30 will be discussed in more detail in conjunction with FIGS. 3 and 4 below.

The anode 14 and cathode 16 are constructed such that each has an aperture 34, 36 disposed opposite each other and in alignment. Once the thyratron 10 is triggered into operation, the main plasma discharge of the thyratron extends from the base of cathode 16 to the base of anode 14 through apertures 34, 36.

The photocathode 30 shown in FIG. 1 comprises a circular electrode 40 having an aperture 37 in the center. The electrical connection to electrode 40 is shown at 42 extending between electrode 40 and a source of electric power 44 (bias voltage). The connection 42 and electrode 40 are supported and insulated by support 46. Connection 42 extends through insulator 48 to the exterior of envelope 12.

In a presently preferred embodiment, photocathode 30 is a small instantly heated coil coated with emissive material (similar to a fluorescent lamp cathode). Alternately, the photocathode is a small self-contained oxide type photosensitive structure, an activated dispenser cathode, a thoriated tungsten cathode or a photomultiplier cathode.

The envelope 12 of the thyratron is evacuated and then backfilled with an elemental gas such as hydrogen or helium as is indicated elsewhere in this specification. A reservoir of an elemental gas (not shown) is the source of the gas used to backfill the thyratron of the present invention.

As described in more detail below, a light source 50 such as a light emitting diode is switched on and light from the light emitting diode passes through window 49 and is incident on photocathode 30 which in turn sets up an electron discharge. The incidence of light on photocathode 30 causes electrons to be injected though aperture 37 into the space adjacent cathode 16 and into the space between the anode and the cathode 16 which in turn produces thyratron firing and the creation of the main switch discharge. The main discharge takes place between the cathode surface 28 and the anode electrode 26, with the photocathode 30 no longer participating in the discharge.

Figure 2:
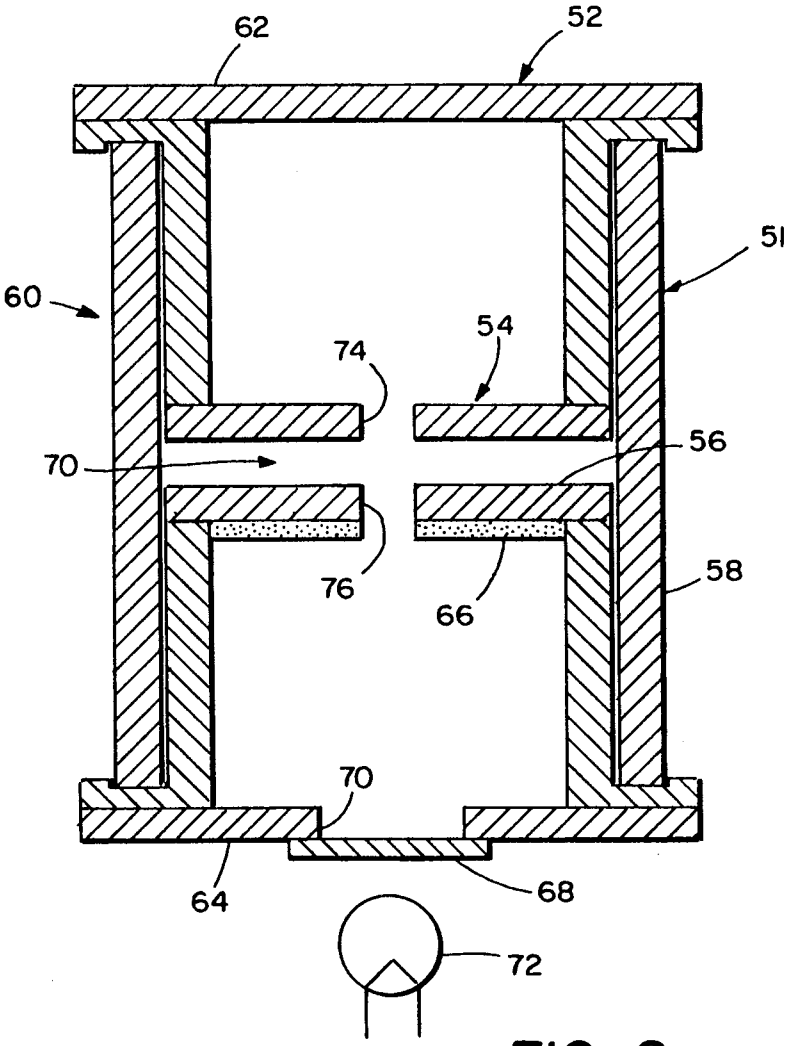
FIG. 2 is a cross-sectional schematic diagram of an alternate embodiment of a backlighted thyratron switch according to the present invention.

Referring now to FIG. 2, an alternate embodiment of the trigger electrode according to the present invention is shown. In this embodiment a backlighted thyratron switch 51 is shown comprising an envelope 52 and a first and a second primary electrode, anode 54 and cathode 56. The envelope 52 is composed of primary insulators 58, 60 and sealing members 62, 64. Anode 54 and cathode 56 are secured to insulators 58, 60 and sealing members 62, 64 are in turn secured to electrodes 54, 56 to provide a vacuum tight enclosed space.

In this embodiment a photosensitive material 66 is deposited on the back side of cathode 56. This photosensitive material can be an oxide type cathode coating of barium, calcium or strontium or a mixture of such elements. A light transmissive window 68 is vacuum sealed to sealing member 64 and covers aperture 70 in said sealing member. A light source 72 such as a light emitting diode (LED) is located externally of the envelope to provide the light energy necessary to excite the photosensitive materials generating electrons which in turn trigger main thyratron firing.

Alternatively, the photosensitive material 66 could be deposited on the backside of anode 54 and the position of window 68, aperture 70, and light source 72 reversed to cause the triggering action from the anode side of the thyratron.

As in the embodiment of FIG. 1, the thyratron switch shown in FIG. 2 is constructed such that anode 54 and cathode 56 each has an aperture 74, 76 deposed opposite each other and in alignment. Once the thyratron 50 is triggered into operation, the main plasma discharge of the thyratron extends from the cathode surface 56 to the anode 54 through the apertures 74, 76.

In operation light source 72 is switched on and light from the light source 72 passes through window 68 and is incident upon photosensitive material 66 which in turn sets up an electron discharge from material 66. The incidence of light causes material 66 to emit electrons which are injected through aperture 76 into the space 70 between the anode and the cathode which in turn produces the main thyratron discharge.

Since only milliamperes of electron emission are required to initiate triggering breakdown, the entire auxiliary cathode can be made quite small, and therefore does not draw heavy amounts of heating power, or take a long time to warm up. Such a cathode can readily be turned on moments before use, or if a true operating-standby mode of operation is desired, only a modest continuous power drain is required, one which is much less than that of a large cathode.

Some cold cathode switches have been made of materials which are heated to start and then switched off to run devices such as fluorescent lights, or, discharge heated thyratron tubes such as those made by EG&G.

Figure 3:
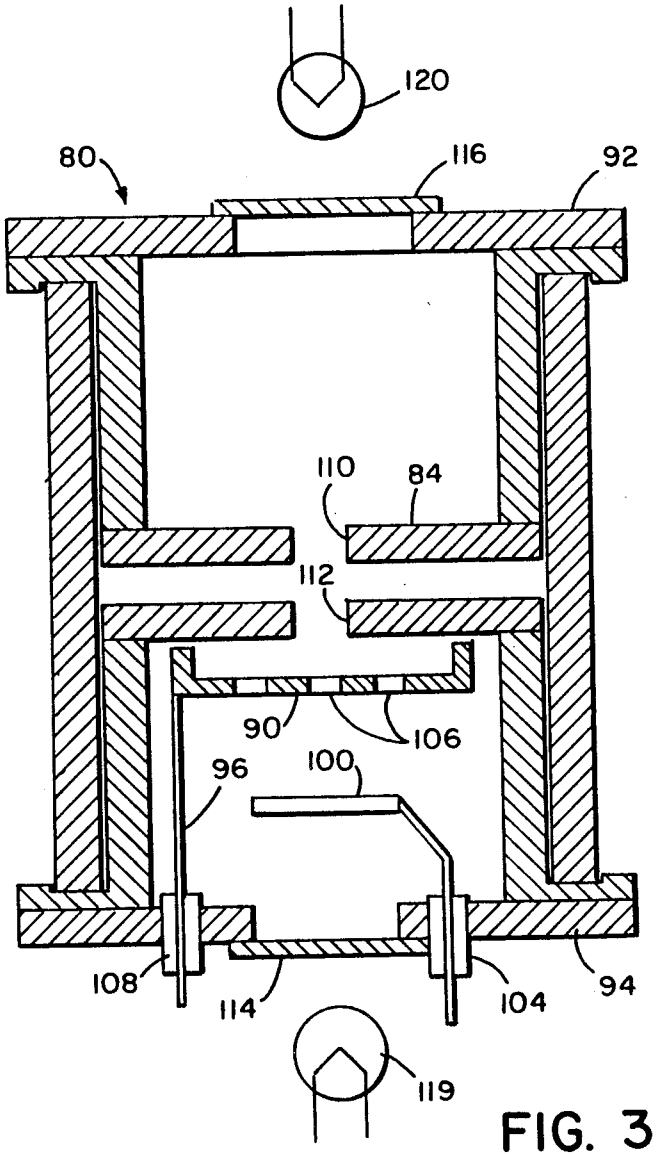
FIG. 3 is a cross-sectional schematic diagram of a presently preferred embodiment of a backlighted thyratron switch according to the present invention using a photocathode and a sweep electrode.

In FIG. 3 is shown a backlighted thyratron switch 80 which is a presently preferred embodiment of the invention. Switch 80 comprises an envelope and a first and second primary electrode 84, 86. The envelope is enclosed by means of a cylindrical insulator 88, and by sealing members 92, 94. Electrodes 84, 86 are secured to insulator 88 and in turn sealing members 92, 94 are secured to the electrodes. In FIG. 3, electrode 84 is the anode and electrode 86 is the cathode.

A photocathode 100 is located a predetermined distance from cathode 86. Photocathode 100 is supported and connected by means of lead 102 through insulator 104 to the exterior of the envelope and to a source of bias voltage as will be discussed in more detail in conjunction with FIG. 4.

A sweep electrode 90 is disposed between photocathode 100 and cathode 86. Sweep electrode 90 is circular in shape and has a plurality of perforations 106. Lead 96 supports and connects the sweep electrode to the exterior of the envelope through insulator 108.

Anode 84 and cathode 86 are provided with circular apertures 110, 112 respectively, with the apertures being disposed opposite each other and in alignment. When thyratron 80 is triggered, the main plasma discharge extends from the base of cathode 86 to the base of anode 84 through apertures 110, 112.

A window 114 is located in the base of thyratron 80 and a second window 116 is located in the top of the thyratron. A first light source 118 is provided externally of the thyratron adjacent window 114. A second light source 120 is located externally of the thyratron adjacent window 116. Energization of either light source is the starting point for triggering the thyratron unit operation.

In this presently preferred embodiment, photocathode 100 is a small, instantly heated coil coated with emissive material such as barium, calcium or strontium or mixtures thereof.

Figure 4:
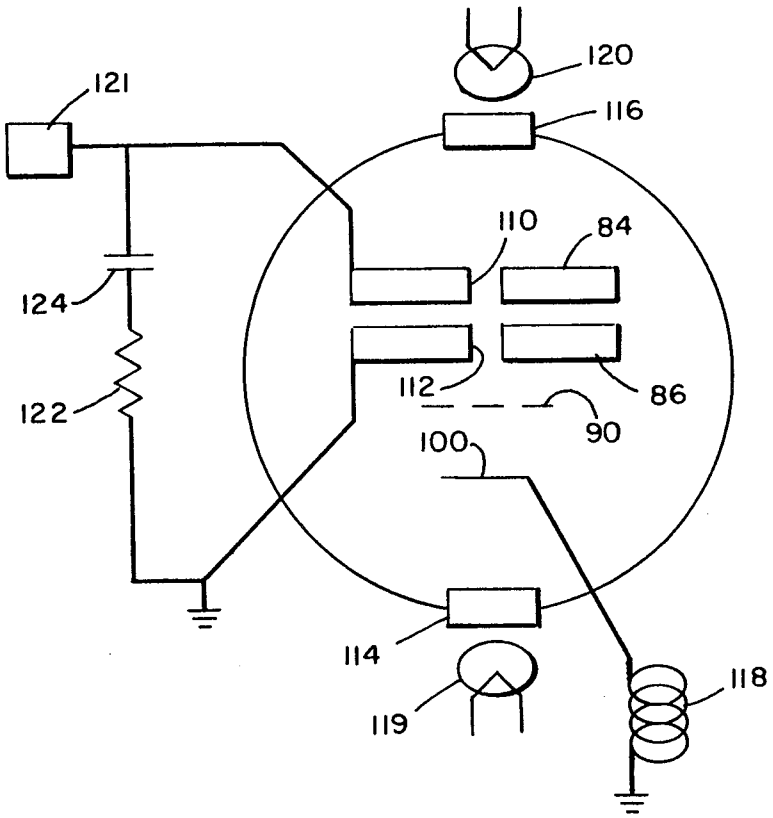
FIG. 4 is a schematic diagram showing the preferred electrical connections for the embodiment of FIG. 3.

The electrical connections of the thyratron 80 shown in FIG. 3 are schematically illustrated in FIG. 4. As shown therein, photocathode 100 is connected to ground through a current limiting impedance 118. Sweep electrode 90 is connected to a source of bias voltage between +10 volts and +50 volts. A source of high voltage 121 is connected to anode 84. A load 122 to be driven by the energy supplied through switch 80 is connected to the cathode 86 and to the high voltage source 120 through capacitor 124. When light source 119 is energized, light from the source passes through window 114 and is incident on photocathode 100. Alternatively, light source 120 can also be utilized to energize the photocathode. In this instance, light source 120 is energized and passes through window 116 and through apertures 110, 112 in the anode and cathode and is incident on photocathode 100 triggering the main plasma discharge and producing the switching function of the present invention.

In a typical mode of operation, high voltage (10–40 kilovolts) is applied to the switch anode, the switch cathode is grounded, the sweep electrode is biased to 10–50 volts and the photocathode is connected to ground through a circuit limiting impedance which can be a choke or wire wound resistor. During voltage holdoff, the sweep electrode serves to prevent breakdown by collecting free electrons that may come near the cathode aperture while during triggering it serves to draw electrons from the photocathode to the switch cathode aperture. The sweep electrode also serves as a baffle to protect the photocathode from the main discharge plasma. To trigger the discharge, light is incident on the photocathode. This light can come from a light source on the cathode side of the switch through the cathode window or from the anode side of the switch through the anode window, anode and cathode apertures and an aperture in the sweep electrode. The incident light liberates photoelectrons from the photocathode which are attracted to the main switch gap by the sweep electrode. Once in the region of the switch aperture, the electrons are attracted by the field of the switch gap and move through the aperture towards the anode initiating the main discharge. The delicate photocathode is prevented from further participation in the discharge by the use of a current limiting impedance which can be external to the switch. This triggering structure gives a simple method of producing the starting electrons required to initiate the Back Lighted Thyratron discharge using a simple light source.

The present invention, using an auxiliary low-power-drain photoemissive cathode in conjunction with a power-carrying cold cathode provides a substantial improvement in the cold cathode thyratron art. Being compact and small, the trigger according to the present invention makes a miniaturized thyratron switch tube possible. The diameters of present day thyratron switches are primarily governed by the size of their cathodes. Elimination of large hot cathodes removes a source of heat dissipation and reduced tube envelope diameter simplifies extraction of heat resulting from other operating dissipations.

Since the trigger energy emerges is emitted from photosensitive materials, it is also possible to decrease the trigger and auxiliary power requirements by a significant factor while still maintaining good triggering characteristics. The present invention thus provides several significant advantages in a cold cathode switch, namely zero or low standby power, short warm up, long life, isolation of stages to permit stacking of switches and high overall power gain while at the same time providing a reliable, fast, jitter-free thyratron switch.

What is claimed is:

1. A high power electronic backlighted thyratron switch, comprising:

an evacuated envelope back filled with a selected elemental gas at a predetermined pressure;

an anode located within the envelope having a first aperture;

a cathode located within the envelope at a predetermined distance from the anode and having a second aperture, said anode and cathode being disposed opposite each other, with said first and second apertures in alignment;

means for supplying electrical power to the anode and cathode to provide main discharge current therebetween;

light source means located externally of the envelope, said envelope having a third aperture formed therein;

a window sealed in said third aperture and aligned with said light source means to permit light from said light source means to enter said envelope;

photosensitive means located within the envelope such that light is incident thereon to cause the production of electrons therefrom and their injection through one of said first and second apertures into the space between said anode and cathode to initiate a main discharge; and a sweep electrode disposed adjacent said photosensitive means to prevent said main discharge from impinging directly on said photosensitive means.

2. A thyratron switch according to claim 1 including means for controlling the electrical potential of said sweep electrode means to enhance the isolation of the photosensitive means from the space between anode and cathodes.

3. A thyratron switch according to claim 2 including means for electrically connecting the cathode to zero electrical potential.

4. A thyratron switch according to claim 2 including means for electrically connecting the cathode to a predetermined electrical potential.

5. A thyratron switch according to claim 2 wherein a predetermined gas pressure within the envelope is selected such that high voltage breakdown is prevented at relatively small values of the product of pressure times distance.

6. A thyratron according to claim 5 wherein the predetermined distance between said anode and said cathode is selected such that the product of pressure time distance is relatively small thereby permitting a relatively high electrical potential difference to be sustained between the anode and cathode in the absence of electrical disturbance in the space between said anode and said cathode.

7. A thyratron according to claim 1 wherein said photosensitive means is a biased photocathode comprising an auxiliary electrode having a central aperture, said electrode being coated with photosensitive material.

8. A thyratron according to claim 1 wherein said photosensitive means is a heated coil coated with photosensitive material.

9. A thyratron according to claim 7 wherein the photosensitive coating is selected from the class consisting of barium, strontium, calcium, and combinations thereof.

10. A thyratron according to claim 7 including means for electrically biasing said photocathode means with respect to the cathode.

11. A thyratron according to claim 9 including means for limiting the current which can be drawn from the photocathode during the main discharge between anode and cathode in order to prevent damage thereto.

12. A thyratron according to claim 10 including means for setting the electrical potential of said sweep electrode means to control the degree of electrical isolation of said baffle means.

13. A thyratron according to claim 11 wherein the means for controlling the electrical potential of the sweep electrode means comprises an electrical connection to a source of bias voltage.

14. A thyratron according to claim 12 wherein the electrical potential means setting comprises means for connecting a predetermined electrical potential from an auxiliary supply to the cathode.

* * * * *